US005857595A

United States Patent [19]

Nilson

[11] Patent Number: 5,857,595

[45] **Date of Patent: *Jan. 12, 1999**

[54] SELF-CLOSING APPARATUS

[76] Inventor: Billy Nilson, Hallevadsgatan 2, S-595 35 Mjölby, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 553,505

[22] PCT Filed: May 20, 1994

[86] PCT No.: PCT/SE94/00476

§ 371 Date: Mar. 21, 1996

§ 102(e) Date: Mar. 21, 1996

[87] PCT Pub. No.: WO94/29187

PCT Pub. Date: Dec. 22, 1994

[30] Foreign Application Priority Data

Jun. 4, 1993 [SE] Sweden ..... 9301924

[51] Int. Cl.[6] ..... B65D 37/00

[52] U.S. Cl. ..... 222/212; 222/494

[58] Field of Search ..... 222/212, 492, 222/493, 494, 496

[56] References Cited

U.S. PATENT DOCUMENTS 4,141,474 2/1979 Nilson ..... 222/493

4,699,300 10/1987 Blake ..... 222/494

*Primary Examiner*—Kenneth Bomberg

*Attorney, Agent, or Firm*—Finnegan, Henderson, Farabow, Garrett & Dunner, L.L.P.

[57] ABSTRACT

This invention relates to a self-closing apparatus which enables flowable substance present in a container to be dispensed therefrom. The apparatus includes a flexible diaphragm having an outlet aperture, and a stud which is fixed in relation to the diaphragm and which is located inwardly thereof, wherein the stud so coacts with the outlet aperture that the diaphragm in its normal position will rest with its outlet aperture resiliently in abutment with the stud and therewith close the container, and so that upon application of a pressure difference across the diaphragm to dispense substance from the container, the diaphragm will resiliently move away from the stud and therewith expose the outlet aperture. The diaphragm includes at least two deformation zones which are spaced at different distances from the outlet aperture, wherein these deformation zones extend around the outlet aperture, and are disposed as concentric circles having a center in the outlet aperture, and have the form of folds which include weakenings in the diaphragm thickness, thereby enabling the remainder of the diaphragm to have an uneven thickness without detrimentally affecting the mutual coaction between stud and diaphragm as the closure apparatus opens and closes.

14 Claims, 4 Drawing Sheets

SELF-CLOSING APPARATUS

TECHNICAL FIELD

The present invention relates to a self-closing apparatus which will allow a flowable substance, such as flowable foodstuffs of different kinds, to flow from a container in which they are contained, wherein the apparatus includes a flexible diaphragm having an outlet aperture, and a stud or pin which is fixedly mounted in relation to the diaphragm and located inwardly thereof, wherein the stud so coacts with the outlet aperture that when the diaphragm occupies a normal position the outlet aperture will rest resiliently against the stud and therewith seal the container, and wherein when a pressure difference is applied across the diaphragm to discharge the content of the container, the diaphragm is distanced from the stud and therewith expose the outfeed aperture.

DESCRIPTION OF THE PRIOR ART

Many different solutions concerning self-closing devices for discharging flowable substances from containers of different kinds are known to the art, wherein a typical device as described above will include a resilient diaphragm which seals the outfeed aperture of the device.

One such construction is disclosed in U.S. Pat. No. 4,141,474, which teaches a discharge arrangement that can be readily manufactured and used. However, this known arrangement is encumbered with certain drawbacks, primarily with regard to the manufacture of the apparatus. The main difficulty in manufacture resides in injection-molding the closure diaphragm included in the arrangement, since it has been found difficult to obtain a diaphragm of uniform thickness. Uniform diaphragm thickness is important in order for the diaphragm to move correctly in relation to the stud coacting therewith, such that the discharge aperture will be opened and closed reliably when the apparatus is active.

Another construction is disclosed in U.S. Pat. No. 4,699,300.

SUMMARY OF THE INVENTIVE CONCEPT

An object of the present invention is to avoid the aforesaid drawbacks associated with self-closing closure apparatus for containers and other vessels.

In accordance with the inventive concept, this object is achieved by providing the diaphragm with at least two deformation zones which are located at different distances from the diaphragm outfeed aperture, wherein these deformation zones extend around the outlet aperture and are disposed as concentric circles having a center in the outlet aperture and have the form of folds which include weakenings in the diaphragm thickness, thereby enabling the remainder of the diaphragm to have an uneven thickness without detrimentally affecting the mutual coaction between stud and diaphragm as the closure apparatus opens and closes. These deformation zones enable movement of the diaphragm to be controlled so that its outfeed aperture will always move symmetrically and uniformly in relation to the stud coacting with the diaphragm.

By designing the diaphragm in this way, there is obtained a self-closing closure arrangement which is easy to manufacture in view of the fact that the thickness of the diaphragm is no longer a critical manufacturing parameter, either with regard to its thickness or with regard to a uniform thickness across the diaphragm. An inventive closure arrangement can also be produced cheaply.

Furthermore, there is obtained a self-closing closure apparatus which is both reliable in operation and has a long useful life span.

BRIEF DESCRIPTION OF THE DRAWINGS

The invention will now be described in more detail with reference to the accompanying drawings, in which.

DETAILED DESCRIPTION OF A PREFERRED EMBODIMENT OF THE INVENTION

Figure 1:
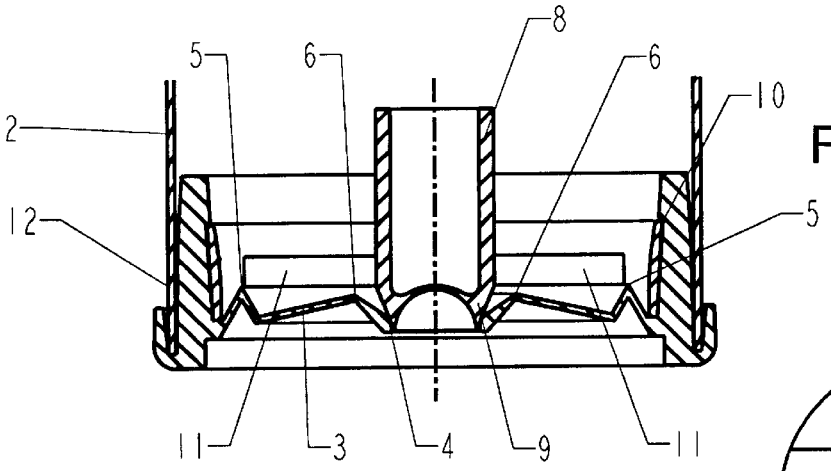
FIG. 1 is an axial section view of an inventive self-closing closure arrangement mounted on a container, and shows the apparatus from one side with the diaphragm in its rest position, i.e., with the apparatus closed.
Figure 1A:
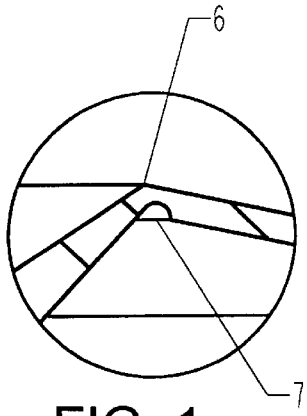
FIG. 1A is an enlarged view of a portion of the closure arrangement of FIG. 1.
Figure 2:
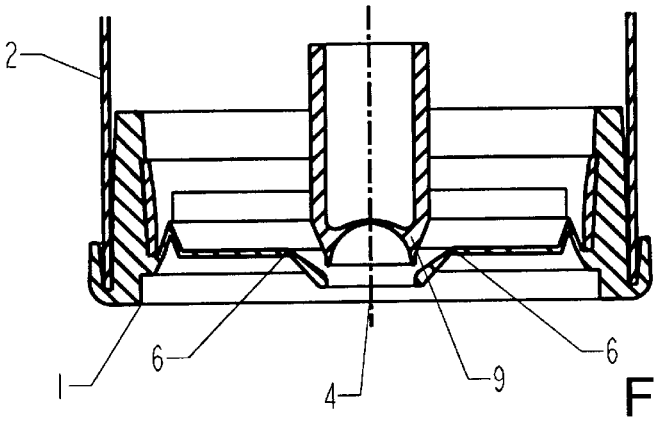
FIG. 2 illustrates the closure apparatus of FIG. 1 in an initial opening stage.
Figure 3:
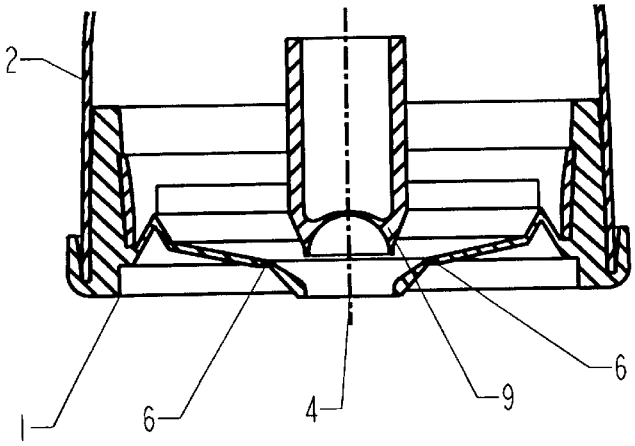
FIG. 3 illustrates the closure apparatus of FIG. 1 when fully opened.

FIGS. 1–3 illustrate a preferred embodiment of an inventive closure apparatus which includes a main body 1, seen in section, onto which there is fitted a container 2 which contains a flowable substance. In the illustrated case, the container is compressible, i.e. can be compressed to discharge its contents, and may, for instance, have the form of a conventional tube comprising slightly resilient walls. The mainbody 1 is preferably made of a plastic material and has the form of an annulus which is pressed or welded over the discharge orifice of the container 2. The main body also includes a diaphragm 3 which is moulded or injection-moulded integrally with the main body 1 and which has a central, circular discharge aperture 4. The diaphragm 3 includes deformation zones in the form of circular folds 5 and 6 located at mutually different distances from the aperture 4 and concentrically therewith. The folds 5, 6 are orientated so that the diaphragm will have a conical shape, with the narrow part of the diaphragm facing in the discharge direction in the proximity of the aperture 4, but has in its entirety, obtained immediately in conjunction with manufacture, a slightly conical shape with the apex of the cone facing inwardly towards the container 2. As illustrated in FIG. 1*a,* the folds include weakenings 7, preferably in the form of grooves.

The closure apparatus also includes a central stud or pin 8 which has a conical part 9 intended for coaction with the aperture 4 in the diaphragm 3. The stud 8 is held centralized by a slightly conical ring 10, with the aid of spoke-like arms 11.

The annular main body 1 is provided in the proximity of the diaphragm 3 with an internal groove 12 having a shape complementary to the outer contours of the slightly conical ring 10. When mounting the stud 8, the ring 10 is pushed into the groove 12 from that side of the main body, which is intended to face in towards the container 2.

In the constructive design of the closure apparatus, the groove 12 is positioned so that the stud 8 will lie against the aperture 4 and move the diaphragm into abutment with the stud 8 with a predetermined degree of tension. In its normal position, the diaphragm will close the container as illustrated in FIG. 1.

When the internal container pressure is increased, for instance by compressing the container, the diaphragm 3, and therewith the aperture 4, will move away from the conical part 9 of the stud 4, as illustrated in FIGS. 2 and 3, and substance contained in the container will be pressed out. As soon as the container pressure is normalized, the tension in the diaphragm will cause the diaphragm to return to the position shown in FIG. 1, therewith reclosing the container.

As the internal container pressure increases, the diaphragm will be deformed primarily uniformly in the folds 5, 6, while remaining parts of the diaphragm will remain essentially unaffected, meaning that the aperture 4 in the diaphragm will be displaced generally rectilinearly and symmetrically in the substance discharge direction to and form the stud 8, and will always return to the same position of origin, which is essential to reliable long-term functioning of the apparatus, and also to avoid the closing movement of the diaphragm being obstructed by dry, caked substance.

FIGS. 4–9 illustrate different constructions in which the closure apparatus illustrated in FIGS. 1–3 has been combined with different types of metering or dispensing containers.

These combinations enable the inventive closure apparatus to be used together with other standard types of containers, for instance non-compressible containers.

Figure 5:
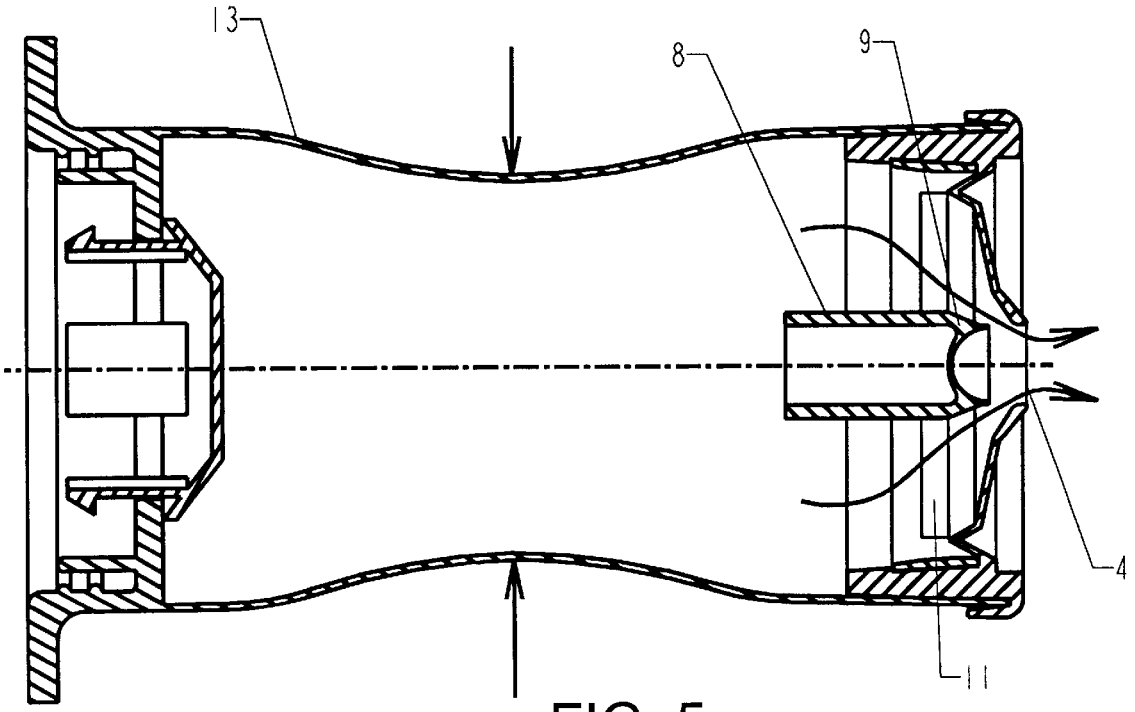
FIG. 5 illustrates the assembly of FIG. 4 in a substance metering or dispensing state.
Figure 4:
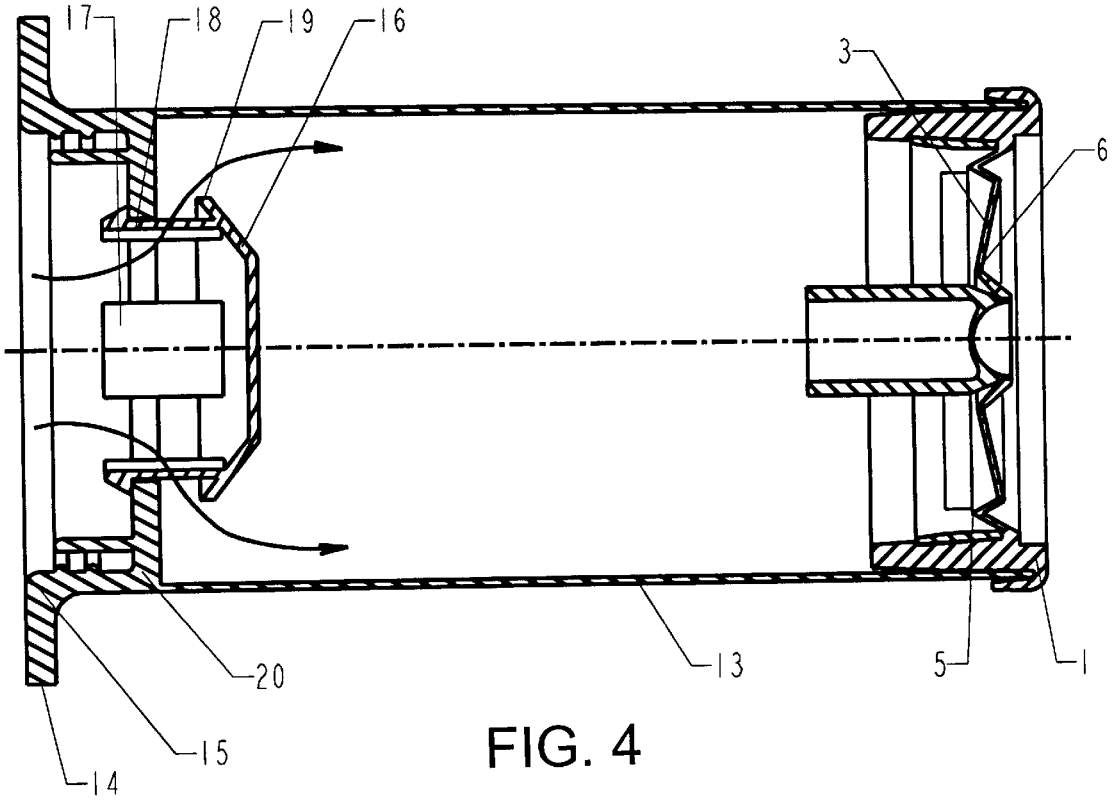
FIG. 4 is an axial sectional view of an inventive closure apparatus combined with a metering or dispensing device in the form of a dispensing container or dispensing chamber fitted to a container, the closure apparatus being shown in closed state.

In the case of the embodiment illustrated in FIGS. 4 and 5, the closure apparatus 1 is mounted at one end of a preferably cylindrical dispensing chamber 13 which has deformable walls and which is provided at its other end with an annular part 14 which includes a check valve. The inner surface of the annular part 14 is provided with internal screw threads 15 for connection to a selected standard container. The annular part 14 includes an inner flange 20 which carries a check valve 16 provided with slide pins 17. Located in the proximity of the slide pins 17 are stop means in the form of hooks 18, and a sealing surface 19 which limits movement of the check valve 16 a between the open position shown in FIG. 4 and the closed position shown in FIG. 5. When in use, the assembly is intended to be positioned generally vertical, as illustrated in FIGS. 4 and 5.

In the starting or normal state of the assembly shown in FIG. 4, the check valve 16 is open and the closure apparatus 1 is closed, wherewith flowable substance is able to flow into the dispensing chamber 13 under the force of gravity, until the dispensing container is full.

When substance is to be dispensed, the user squeezes the walls of the dispensing container, either directly or indirectly, as indicated by the arrows 21 in FIG. 5, so as to increase the pressure in the dispensing container in relation to ambient pressure. The check valve 16 is herewith pressed upwards and closes the inlet from the substance container, so as to enable the pressure in the dispensing container to rise sufficiently for the diaphragm 3 to open and for the content of the dispensing chamber 13 to be pressed out through the discharge aperture 4. When the pressure returns to its normal level after use, the check valve is again opened and the diaphragm 3 is again closed.

Figure 7:
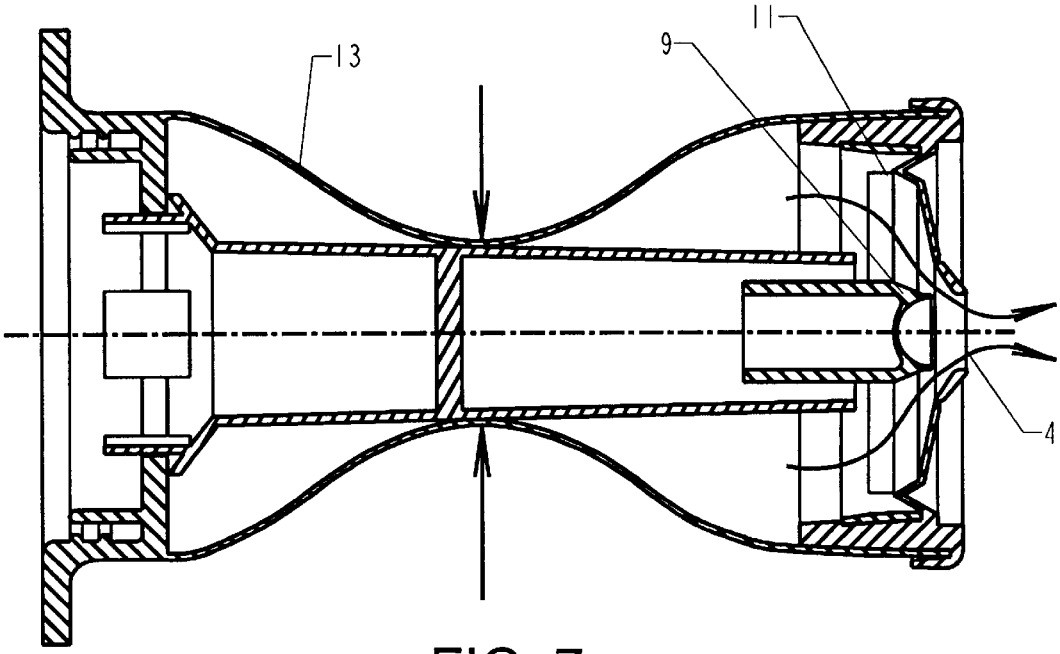
FIG. 7 illustrates the assembly of FIG. 6 in a metering or dispensing state.
Figure 6:
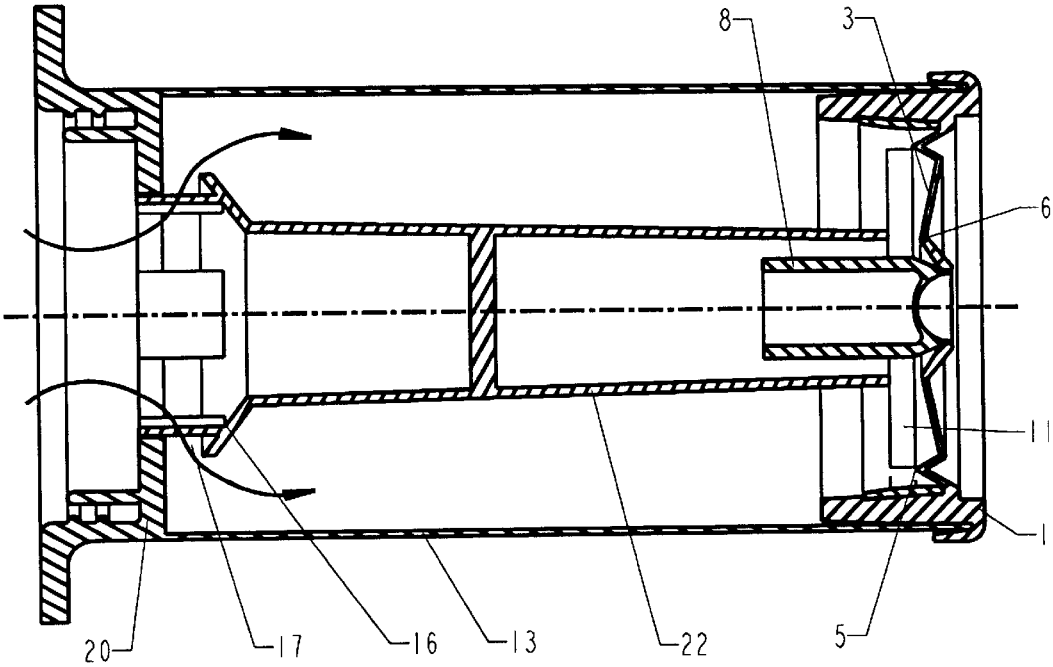
FIG. 6 is an axial section view of an inventive self-closing closure arrangement mounted on a metering or dispensing device with a dispensing limitation in the form of a dispensing chamber in a filling position with the diaphragm in its closing position.

FIGS. 6 and 7 illustrate a variant of the embodiment illustrated in FIGS. 4 and 5, wherein the difference between the two embodiments lies mainly in the fact that the check valve 16' is provided with an elongated, tubular body which overlaps and surrounds the stud 8, and the movement of which is controlled or guided by the slide pins 17' and by the stud 8. When the check valve is in its normal, open position, the lower end of the body rests on the arms 11, meaning, among other things, that the hooks 18 mentioned with reference to the preceding Figures are not necessary, which may be an advantage from the aspect of manufacture. Apart from this difference, the arrangement works analogously with the apparatus illustrated in FIGS. 4 and 5.

However, an important function of the body 22 is that of providing a dispensing or metering limitation. As evident from FIG. 7, the body 22 limits the extent to which the dispensing chamber is compressed, therewith also limiting the amount of substance that can be dispensed from the dispensing chamber in a definable fashion.

Figure 9:
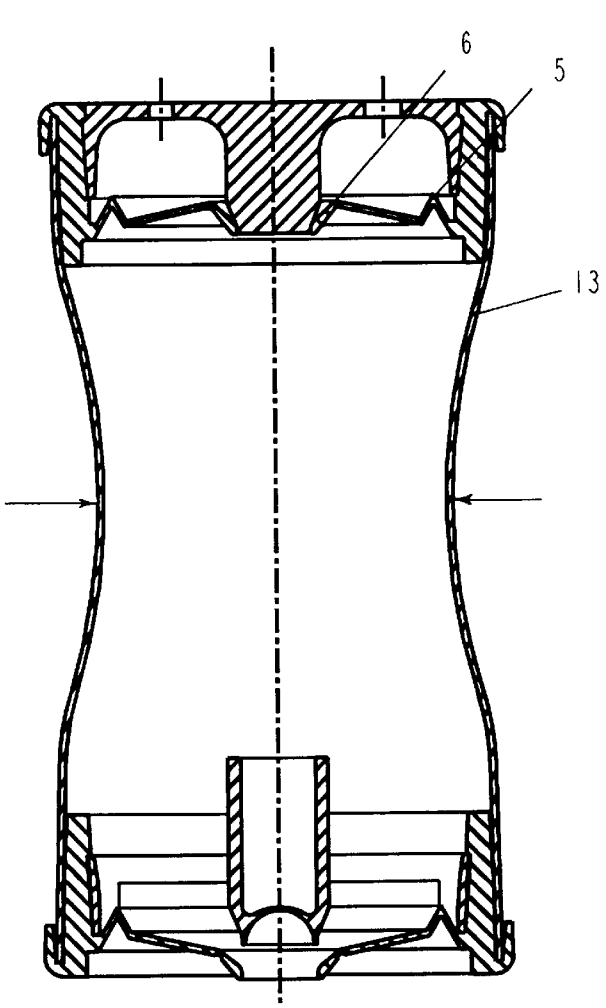
FIG. 9 illustrates the assembly of FIG. 8 in a metering or dispensing state.
Figure 8:
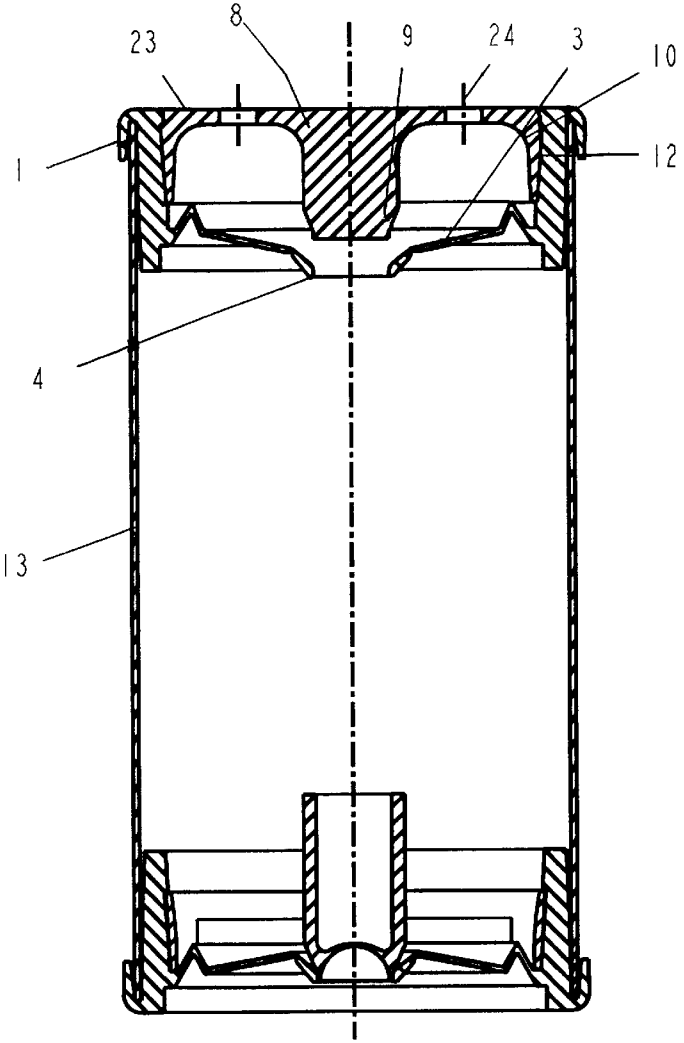
FIG. 8 is an axial section view of an inventive self-closing closure apparatus combined with an air-suction dispensing container with the diaphragm in a filling position.

FIGS. 8 and 9 illustrate a further variant, including an air-suction container. In the case of this embodiment, the container 13, which has been constructed essentially in the same way as the aforedescribed dispensing chambers, is provided with an inventive closure apparatus 1, 1' at both ends thereof, wherein one apparatus, 1, works in the same manner as in the aforedescribed embodiment and need not therefore be described in greater detail, whereas the other apparatus functions as an air-suction check valve. Seen constructively, the sole difference with this variant is that the container walls will preferably be highly deformable elastically, and the stud 8' is attached to a disc 23 provided with air holes 24 instead of arms 11.

FIG. 9 illustrates that the valve 1' is closed in the dispensing state of the assembly when the walls of the container 13' are deformed elastically by the user, and shows that the closure apparatus 1 is opened as a result of the higher internal pressure, wherein substance is dispensed.

Immediately the user removes the force acting on the container 13, the container pressure will fall and therewith cause the closure apparatus 1 to close. Because the container walls are elastic, the walls will strive to retake their original form, therewith causing the pressure in the container to fall further, wherein the valve 1' is opened and air is able to flow into the container and equalize the container pressure so that the valve 1' is again closed.

It will be understood that the described and illustrated embodiments of the invention can be modified in many ways within the scope of the following claims.

For instance, the pressure difference across the valve can be achieved in ways other than by deforming the walls of the containers or chambers. For instance, this pressure difference may be achieved alternatively with the aid of a displaceable plunger or like device.

I claim:

1. A self-closing apparatus which permits a flowable substance present in a container to be dispensed therefrom, wherein the apparatus has an inside and an outside and includes a flexible diaphragm having an outlet aperture, and a stud which is fixed in relation to the diaphragm and which is located inwardly thereof, wherein the stud so coacts with the outlet aperture that the diaphragm in its normal position will rest with its outlet aperture resilently in abutment with the stud and therewith close the container, and so that upon application of a pressure difference across the diaphragm to dispense substance from the container, the diaphragm will resiliently move away from the stud and therewith expose the outlet aperture, wherein the diaphragm includes at least two deformation zones which are spaced at mutually different distances from the outlet aperture, are disposed as concentric circles having a center in the outlet aperture, and have the form of folds which include weakenings in the diaphragm thickness, at least two of the at least two deformation zones being directed toward the inside of the apparatus, thereby enabling the remainder of the diaphragm to have an uneven thickness without detrimentally affecting the mutual coaction between the stud and the diaphragm as the closure apparatus opens and closes.

2. An apparatus according to claim 1, wherein the weakenings are in the form of grooves.

3. An apparatus according to claim 1, wherein the diaphragm is circular; and in that the outlet aperture is in the form of a centrally positioned circular hole.

4. An apparatus according to claim wherein the stud has a conical shape.

5. A self-closing closure having an inside and an outside and including a flexible diaphragm with an outlet aperture and a stud which coacts with the outlet aperture to close the aperture when the diaphragm is in its normal position and to open the aperture to permit a flowable substance to be dispensed therethrough when the diaphragm is moved away from the stud upon the application of a pressure difference across the diaphragm, wherein the diaphragm includes at least two spaced deformation zones disposed substantially as concentric circles having centers at the outlet aperture, at least two of the at least two deformation zones being directed toward the inside of the closure, said deformation zones including weakenings in the thickness of the diaphragm to enable the remainder of the diaphragm to have an uneven thickness without detrimentally affecting the mutual coaction between the stud and the diaphragm as the self-closing closure opens and closes.

6. A self-closing apparatus for permitting a flowable substance present in a container to be dispensed therefrom, wherein the apparatus has an inside and an outside and includes a flexible diaphragm having an outlet aperture, and a stud which is fixed in relation to the diaphragm and which is located inwardly thereof, wherein the stud so coacts with the outlet aperture that the diaphragm in its normal position will rest with its outlet aperture resilently in abutment with the stud and therewith close the outlet aperture, and so that upon application of a pressure difference across the diaphragm, the diaphragm will resiliently move away from the stud and therewith expose the outlet aperture, and wherein the diaphragm includes deformation zones conformed as at least two folds, at least two of the at least two folds being directed toward the inside of the apparatus, each fold having a weakening in the diaphragm thickness, said folds being spaced at mutually different distances from the extending around the outlet aperture, the diaphragm further having an uneven thickness without detrimentally affecting the mutual coaction between the stud and diaphragm as the closure apparatus opens and closes.

7. A apparatus according to claim 6, wherein the weakening in each fold is a groove formed in the diaphragm thickness.

8. An apparatus according to claim 6, wherein the diaphragm is circular, and the outlet aperture is a centrally positioned circular hole.

9. An apparatus according to claim 6, wherein the stud is conical.

10. A self-closing apparatus for permitting a flowable substance present in a container to be dispensed therefrom, wherein the apparatus has an inside and an outside and includes a flexible diaphragm having an outlet aperture, and a stud which is fixed in relation to the diaphragm and extends toward said outlet aperture, and the diaphragm in its rest position inclines inwardly from its periphery toward said stud and rests with its outlet aperture resilently in abutment with the stud and therewith closes the outlet aperture, and upon application of a pressure difference across the diaphragm, the diaphragm will resiliently move away from the stud and therewith expose the outlet aperture to dispense the flowable substance, and wherein the diaphragm includes deformation zones conformed as at least two folds, at least two of the at least two folds being directed toward the inside of the apparatus, each fold having a weakening in the diaphragm thickness, said folds being spaced at mutually different distances from and extending around the outlet aperture, the diaphragm further accommodating an uneven thickness without detrimentally affecting the mutual coaction between the stud and diaphragm as the closure apparatus opens and closes.

11. A apparatus according to claim 10, wherein the weakening in each fold is a groove formed in the diaphragm thickness.

12. An apparatus according to claim 11, wherein the diaphragm is circular, and the outlet aperture is a centrally positioned circular hole.

13. An apparatus according to claim 12, wherein the stud is conical.

14. An apparatus according to claim 10, wherein the diaphragm by inclining inwardly at rest assumes the shape of a concave cone whose apex points in a direction toward the container to which the self-closing apparatus will attach.

* * * * *